US011549347B2

(12) United States Patent
Hunter et al.

(10) Patent No.: US 11,549,347 B2
(45) Date of Patent: Jan. 10, 2023

(54) CONTROL SYSTEM FOR CONTROLLING FLOW RATES OF TREATMENTS USED IN HYDRAULIC FRACTURING

(71) Applicant: Halliburton Energy Services, Inc., Houston, TX (US)

(72) Inventors: Timothy Holiman Hunter, Duncan, OK (US); Stanley V. Stephenson, Duncan, OK (US); Ubong Akpan Inyang, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/414,761

(22) PCT Filed: Jan. 10, 2019

(86) PCT No.: PCT/US2019/013065
§ 371 (c)(1),
(2) Date: Jun. 16, 2021

(87) PCT Pub. No.: WO2020/145979
PCT Pub. Date: Jul. 16, 2020

(65) Prior Publication Data
US 2022/0074293 A1 Mar. 10, 2022

(51) Int. Cl.
*E21B 43/26* (2006.01)

(52) U.S. Cl.
CPC ..... *E21B 43/26* (2013.01); *E21B 43/2607* (2020.05)

(58) Field of Classification Search
CPC ..... E21B 43/26; E21B 43/2607
See application file for complete search history.

(56) References Cited

U.S. PATENT DOCUMENTS

| | | | |
|---|---|---|---|
| 4,821,564 | A | 4/1989 | Pearson et al. |
| 6,644,844 | B2 | 11/2003 | Neal et al. |
| 7,004,254 | B1 | 2/2006 | Chatterji et al. |
| 7,090,017 | B2 | 8/2006 | Justus et al. |
| 7,841,394 | B2 | 11/2010 | McNeel et al. |
| 7,946,340 | B2 | 5/2011 | Surjaatmadja et al. |
| 8,162,048 | B2 | 4/2012 | Termine et al. |
| 9,581,004 | B2 | 2/2017 | Ciezobka et al. |
| 9,863,228 | B2 | 1/2018 | Shampine et al. |

(Continued)

OTHER PUBLICATIONS

International Search Report and Written Opinion dated Oct. 11, 2019; Interational PCT Application No. PCT/US2019/013065.

*Primary Examiner* — James G Sayre
(74) *Attorney, Agent, or Firm* — McGuireWoods LLP

(57) ABSTRACT

A system for use in hydraulic fracturing of at least one reservoir. The system including at least one pump for injecting a friction modifier into a wellbore, at least one friction modifier controller for controlling an amount of friction modifier channeled through at least one well bore, and at least one injector. The friction modifier controller is configured to monitor at least one of a fluid flow rate and pressure associated with each wellbore, compare the at least one of the fluid flow rate and the pressure with at least one of a desired flow rate and desired pressure, and adjust a friction modifier level for at least one wellbore based on results of the comparison. The injector is configured to control the pump to deliver an amount of a friction modifier into the wellbore based on the friction modifier level.

20 Claims, 4 Drawing Sheets

(56) References Cited

U.S. PATENT DOCUMENTS

| | | | | |
|---|---|---|---|---|
| 9,879,514 | B2 | 1/2018 | Ciezobka et al. | |
| 2009/0090504 | A1* | 4/2009 | Weightman | G01N 11/04 166/250.01 |
| 2010/0059226 | A1* | 3/2010 | Termine | C09K 8/66 166/308.1 |
| 2012/0018148 | A1* | 1/2012 | Bryant | E21B 43/114 166/250.01 |
| 2014/0051610 | A1* | 2/2014 | Perry | E21B 43/16 166/305.1 |
| 2014/0352968 | A1 | 12/2014 | Pitcher et al. | |
| 2017/0350222 | A1 | 12/2017 | Gullickson et al. | |

* cited by examiner

CONTROL SYSTEM FOR CONTROLLING FLOW RATES OF TREATMENTS USED IN HYDRAULIC FRACTURING

TECHNICAL FIELD OF THE DISCLOSURE

The present disclosure relates, in general, to hydraulic fracturing and, in particular, to simultaneous fracturing and control systems used to control rates of stimulation treatments to multiple wellbores.

BACKGROUND

Simultaneous fracturing (SimulFrac) is the concept of stimulating more than one well, usually parallel to each other or in very close proximity, at the same time. The treatment is done using the same fracturing crew and/or equipment. The operation can also be done with multi crews and/or equipment pumping the wells simultaneously too. In practice, SimulFrac involves the use of a mechanical modulation means, such as valves and chokes, to adjust flow rates between wells being stimulated. These mechanical modulation methods cause localized erosion, waste of fluid pumped into each well, shortens component life, and requires time and labor. As such, there is a need for a solution that reduces damage to the environment and resource consumption.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
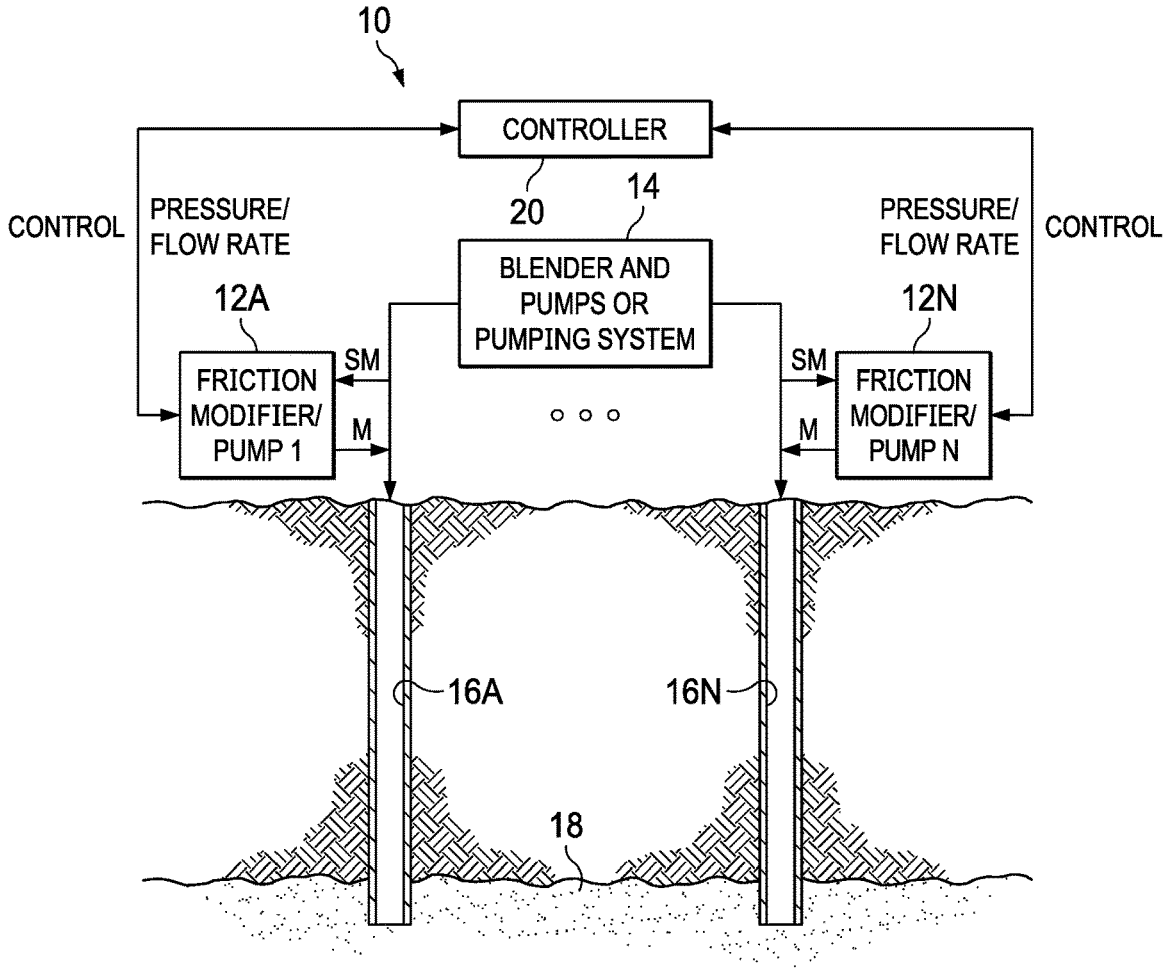
FIG. 1 is an illustration of a wellsite and control system used to manage simultaneous fracturing operations, in accordance with certain example embodiments.

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

A challenge with simultaneously treating multiple wells with a single primary fluid pumping system is that the flow distribution to each well is directly a function of the inherent resistance of each well. There are multiple flow-related frictional components of resistance to flow in each well: the resistance of the reservoir itself; the "pipe friction" caused by all the tubulars in the well; and friction across any flow restrictions such as perforations. Traditional means of controlling distribution of treating fluid to each of multiple wells being treated with a single primary fluid pumping system, would typically include the use of physical flow control devices such as valves or chokes. However, such point-source flow control devices are prone to wear with abrasive fluids and, as such, are not very practical in practice because pressure a drop occurs in a localized area causing concentrated wear.

A solution to overcome these limitations are presented herein. In essence, the solution uses physics of fluid flow along an entire wellbore and formation as a means to control distribution of flow by using friction modifiers to alter the frictional resistance of each well individually. A common treatment fluid is supplied from a single pumping system toward all wells being simultaneously treated. The single fluid can then enter branched conduits to each well. After the branching, friction modifiers can be introduced to each individual branch/well to alter the flow resistance of each well. This alteration of inherent resistance is used to control fluid flow to each of the multiple wells, instead of using valves, chokes, and/or other "point-source" flow control devices.

The systems and methods presented herein controls flow rates to one or more wellbores by determining and adjusting flow rates of stimulation treatments in one or more divisions of a flow stream, e.g. a single primary flow stream. The systems and methods presented herein can use friction reducers and/or modifiers as the sole flow control means, or in combination with mechanical modulation means, in the one or more divisions to control flow rates in each wellbore. The systems and methods presented herein can use friction reducers and/or modifiers in combination with mechanical modulation means, such as valves and chokes, to control flow rate to each well during a simultaneous stimulation treatment. Friction reducers and/or modifiers can be used to increase or decrease friction pressure.

Referring now to FIG. 1, illustrated is a wellsite and control system used to manage simultaneous fracturing operations, according to certain example embodiments, denoted generally as 10. The well site and system 10 comprises pumps 12A to 12N, blender 14, wellbores 16A-16N, shale deposit 18, and controller 20. Each pump 12 is in fluid communication with a friction reducer. The blender 14 provides a slurry to the wellbores 16A-16N, which can be high pressure pumps, which discharge the slurry into a respective wellbore at a set flow rate. The controller 20 can be a master controller or each pump can include a controller for monitoring, measuring, and adjusting the flow rate of slurry delivered to one or more well bores. The controller 20 can control the flow rate by controlling the amount of friction reducer and/or modifier injected into the slurry and/or controlling the flow rate of the slurry.

As an example, if one wellbore is treating at a lower pressure, that wellbore will start taking more fluid, i.e. slurry. Controller 20 can determine this and if it also determines that another wellbore is being treated at a higher pressure, the controller 20 can modify or introduce an amount of friction reducer either incrementally until a desired flow rate is reached or based on a predetermined amount based on a desired flow rate. Likewise, the controller 20 can also adjust the friction reducer on the first wellbore thereby increasing its treating pressure and allowing more fluid to the other wellbore. Either of the two above or a combination of both can be used to balance the flow rates from a constant flow rate delivered from the pumps 12. As another example, the controller 20 can monitor the flow rate in one wellbore and the total flow rate, prior to split, and determine the flow rate needed in a second wellbore.

As previously stated, the controller 20 can be a master controller or each pump can include a controller. In the former case, the master controller is communicable coupled to a flow rate sensor and/or pressure sensor for monitoring or sampling (SM) flow rates for each wellbore and communicable coupled to the pumps to cause the pumps to adjust the amount of friction modifier/reducer (M) injected into the wellbores. In the latter case, each pump is equipped with a controller with each controller communicable coupled to a pump's flow rate sensor and/or pressure sensor. The controller in this case can also be coupled to neighboring controllers. In one embodiment of the latter case, each controller can be designated as a master and act as a master. In other words, through a handshake negotiation procedure, communicable linked pumps can negotiate so that one is designated as being a master. In another embodiment, each controller can monitor its own flow rate/pressure and report the measurements to neighboring controllers. In this embodiment, each controller 20 can adjust flow rate of fluid into their respective wellbore based on a preset desired flowrate for that particular wellbore.

It should be understood that the controller 20 can either be communicably coupled directly to the flow rate sensor and/or pressure sensor or indirectly through the pump's own pump controller. In addition, the controller 20 can monitor and measure and/or only monitor and measure. Furthermore, the flow rate can be adjusted by controlling how much, i.e. the rate, each pump pumps slurry into a respective wellbore. It can also mean a change in the amount of friction reducer being injected into a wellbore. It can also mean introducing an amount of friction reducer into a wellbore. It can also mean a combination of any of those mentioned.

Figure 2A:
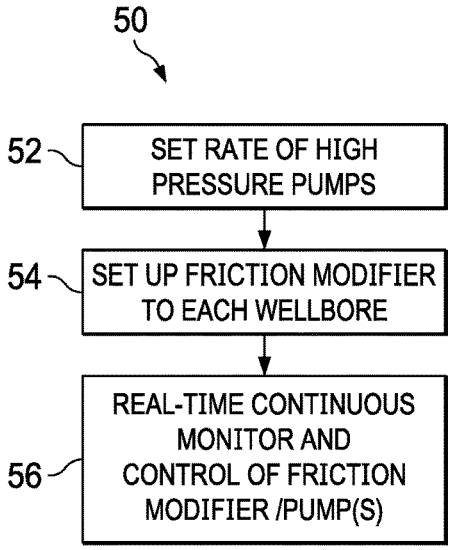
FIG. 2A and FIG. 2B are illustrations of flow charts for algorithms for managing pump flow rates, in accordance with certain example embodiments.
Figure 2B:
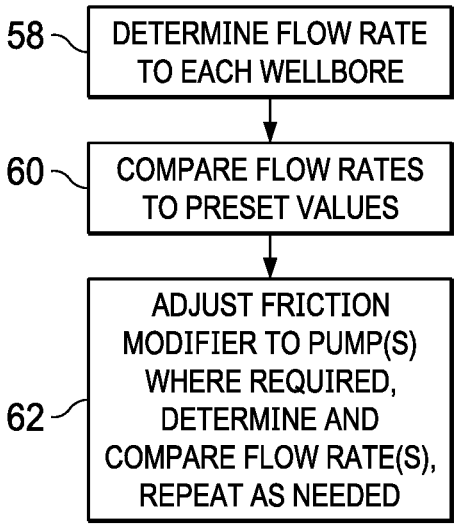

Referring now to FIGS. 2A and 2B, illustrated are flow charts of an algorithm for managing pump flow rates, according to certain example embodiments, denoted generally as 50. The algorithm 50 begins at block 52 where the flow rate of each pump is set. Next, block 54, the friction modifier level for each wellbore is set. Obviously, the shale 18 or its rigidity will contribute to the actual flow rate for fluid channeled into a wellbore. Next, block 56, the algorithm 50 can then enter into continuous monitoring of the pump(s). I.e., the monitoring of the flow rate and pressure measurements. This block can also include performing the actual measurements. The process of monitoring and measuring can be continuous, e.g. every 30 minutes, every hour, every two hours, etc. . . . or it can be real-time continuous monitoring. At block 58, the flow rate to each wellbore can be determined. The flow rates can be compared to preset values, block 60, and the friction reducer to a pump or pumps can be adjusted, block 62. The algorithmic process 50 can repeat as much as needed to keep the fracturing process in balance. In addition, the algorithm 50 can use one preset value so that a constant flow rate is maintained to each wellbore. Furthermore, the algorithm 50 can vary the rate to each well in a timely manner. E.g. if the total flow from the blender is 40 bpm, the algorithm 50 can start the flow rate to each wellbore at 20 bpm and then midway through go to 30 bpm to one and 10 bpm to another and then cycle back and forth.

Figure 3:
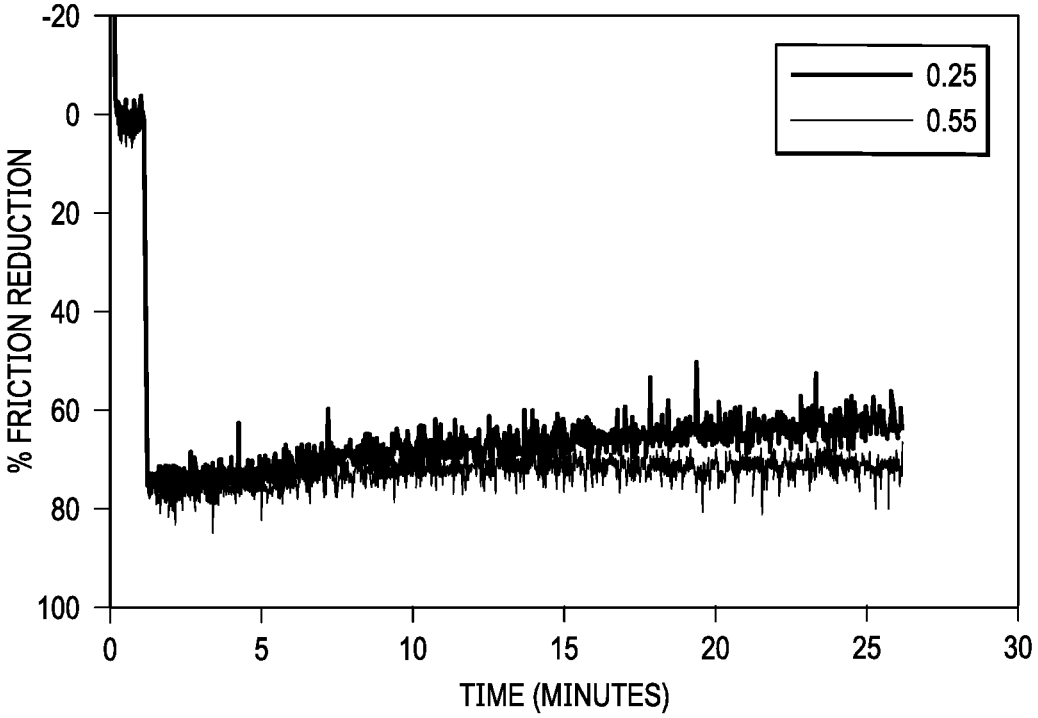
FIG. 3 and FIG. 4 are illustrations of charts demonstrating the friction pressure reduction of different concentrations of friction reducer and linear gel.
Figure 4:
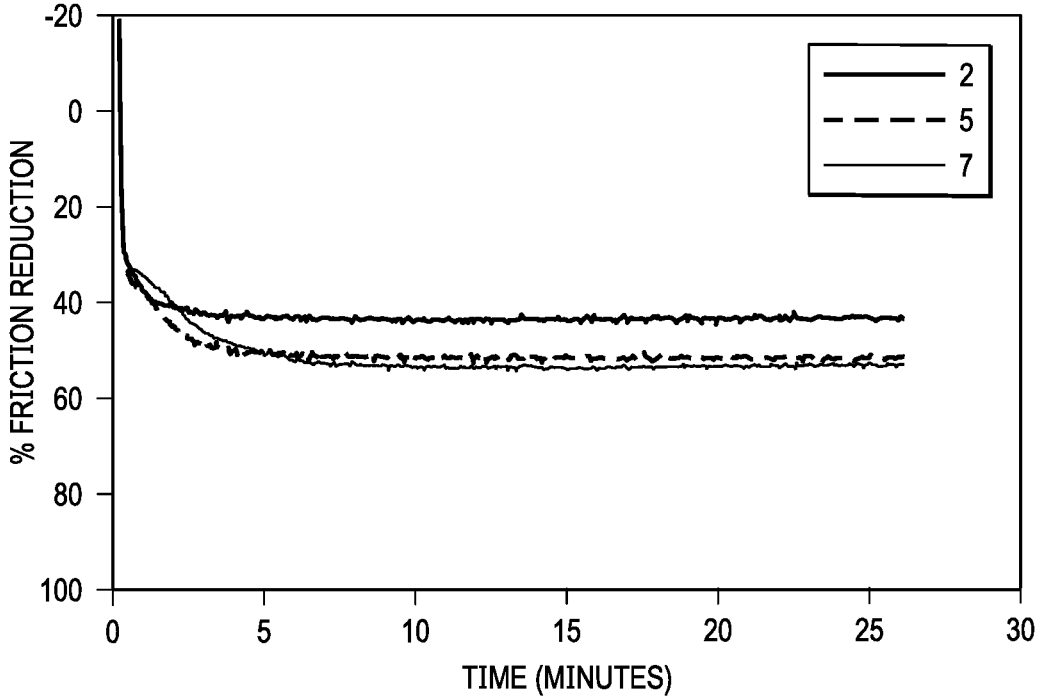

Referring now to FIG. 3 and FIG. 4, illustrated are charts demonstrating the friction pressure reduction of different concentrations of friction reducer and linear gel. In FIGS. 0.25 and 0.5 gpt resulted in about 60% and 70% friction reduction. In FIG. 4, 2 ppt, 5 ppt, and 7 ppt of WG 11 resulted in 44%, 50% and 54% friction reduction, respectively. The charts demonstrate that decreasing the friction reducer or linear gel can affect the pressure during pumping, which can then be used to change the flow rate for the treatment.

Figure 5:
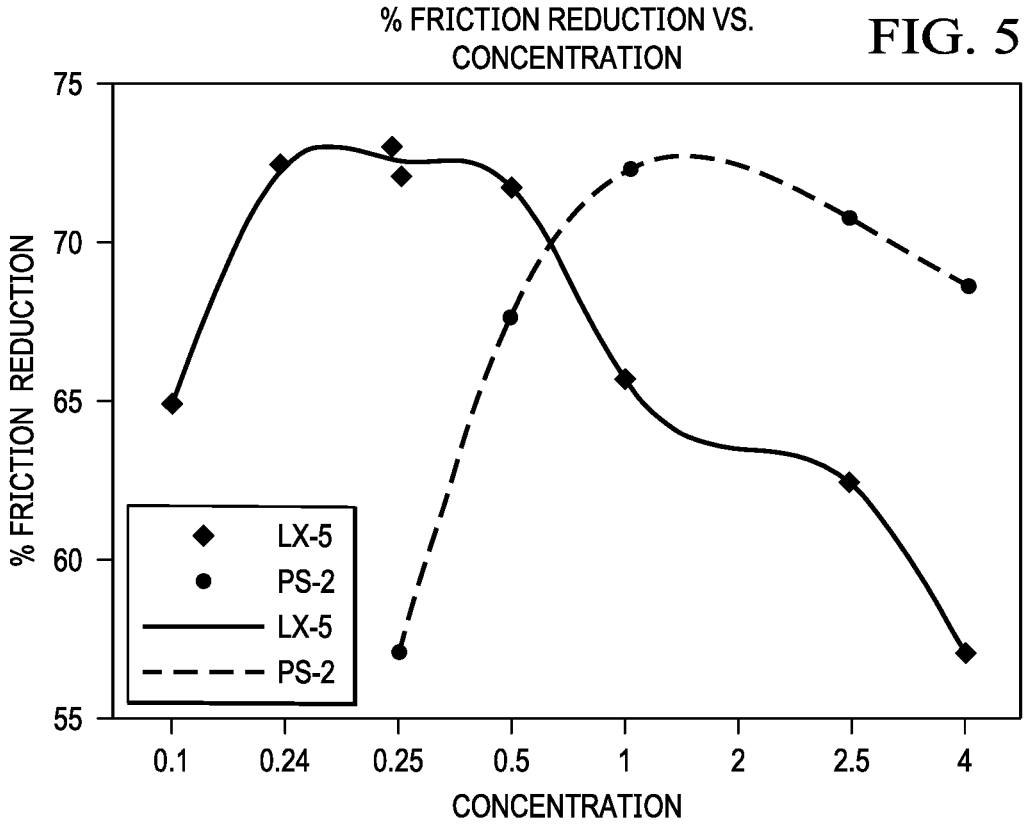
FIG. 5 is an illustration of another chart comparing the amount of friction reduction versus concentration for various different friction reducers.

Referring now to FIG. 5, illustrated is another chart comparing the amount of friction reduction versus concentration for various different friction reducers. At 0.25 gpt, PS-2 gives about 57% friction reduction while LX-5 gives about 73% friction reduction at the same concentration. Therefore, instead of increasing the concentration of LX-5 to 1 gpt to get equivalent friction performance, one could use LX-5 at 0.25 gpt and get better performance. It should be noted, increasing the friction reducer concentration to a certain point can also begin to negatively affect the percent friction pressure reduction obtained, especially if the intent is also to help with proppant transport. So, as the concentration of LX-5 increases from 0.25 to 1 gpt the friction reduction decreases from 73% to about 66% however the friction reduction for PS-2 at 1 gpt is about 72%.

Figure 6:
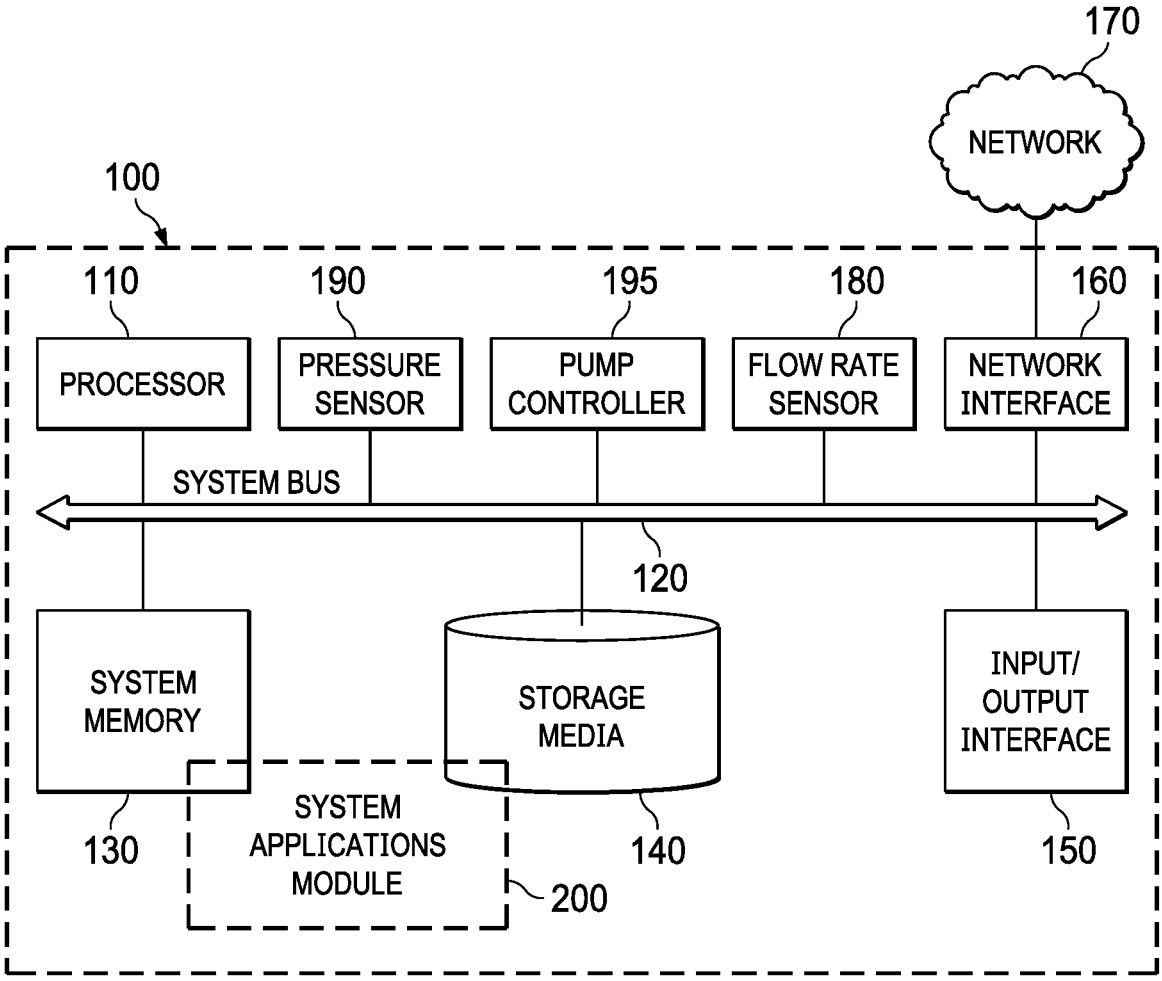
FIG. 6 is a block diagram depicting a computing machine and system applications, in accordance to certain example embodiments.

Referring now to FIG. 6, illustrated is a computing machine 100 and a system applications module 200, in accordance with example embodiments. The computing machine 100 can correspond to any of the various computers, mobile devices, laptop computers, servers, embedded systems, or computing systems presented herein. The module 200 can comprise one or more hardware or software elements, e.g. other OS application and user and kernel space applications, designed to facilitate the computing machine 100 in performing the various methods and processing functions presented herein. The computing machine 100 can include various internal or attached components such as a processor 110, system bus 120, system memory 130, storage media 140, input/output interface 150, and a network interface 160 for communicating with a network 170, e.g. cellular/GPS, Bluetooth, or WIFI, a flow rate sensor 180, a pressure sensor 190, and a pump controller 195.

The computing machine 100 can be implemented as a conventional computer system, an embedded controller, a laptop, a server, a mobile device, a smartphone, a wearable computer, a customized machine, any other hardware platform, or any combination or multiplicity thereof. The computing machine 100 can be a distributed system configured to function using multiple computing machines interconnected via a data network or bus system.

The processor 110 can be designed to execute code instructions in order to perform the operations and functionality described herein, manage request flow and address mappings, and to perform calculations and generate commands. The processor 110 can be configured to monitor and control the operation of the components in the computing machines. The processor 110 can be a general purpose processor, a processor core, a multiprocessor, a reconfigurable processor, a microcontroller, a digital signal processor ("DSP"), an application specific integrated circuit ("ASIC"), a controller, a state machine, gated logic, discrete hardware components, any other processing unit, or any combination or multiplicity thereof. The processor 110 can be a single processing unit, multiple processing units, a single processing core, multiple processing cores, special purpose processing cores, co-processors, or any combination thereof. According to certain embodiments, the processor 110 along with other components of the computing machine 100 can be a software based or hardware based virtualized computing machine executing within one or more other computing machines.

The system memory 130 can include non-volatile memories such as read-only memory ("ROM"), programmable read-only memory ("PROM"), erasable programmable read-only memory ("EPROM"), flash memory, or any other device capable of storing program instructions or data with or without applied power. The system memory 130 can also include volatile memories such as random access memory ("RAM"), static random access memory ("SRAM"), dynamic random access memory ("DRAM"), and synchronous dynamic random access memory ("SDRAM"). Other types of RAM also can be used to implement the system memory 130. The system memory 130 can be implemented using a single memory module or multiple memory modules. While the system memory 130 is depicted as being part of the computing machine, one skilled in the art will recognize that the system memory 130 can be separate from the computing machine 100 without departing from the scope of the subject technology. It should also be appreciated that the system memory 130 can include, or operate in conjunction with, a non-volatile storage device such as the storage media 140.

The storage media 140 can include a hard disk, a floppy disk, a compact disc read-only memory ("CD-ROM"), a digital versatile disc ("DVD"), a Blu-ray disc, a magnetic tape, a flash memory, other non-volatile memory device, a solid state drive ("SSD"), any magnetic storage device, any optical storage device, any electrical storage device, any semiconductor storage device, any physical-based storage device, any other data storage device, or any combination or multiplicity thereof. The storage media 140 can store one or more operating systems, application programs and program modules, data, or any other information. The storage media 140 can be part of, or connected to, the computing machine. The storage media 140 can also be part of one or more other computing machines that are in communication with the computing machine such as servers, database servers, cloud storage, network attached storage, and so forth.

The applications module 200 and other OS application modules can comprise one or more hardware or software elements configured to facilitate the computing machine with performing the various methods and processing functions presented herein. The applications module 200 and other OS application modules can include one or more algorithms or sequences of instructions stored as software or firmware in association with the system memory 130, the storage media 140 or both. The storage media 140 can therefore represent examples of machine or computer readable media on which instructions or code can be stored for execution by the processor 110. Machine or computer readable media can generally refer to any medium or media used to provide instructions to the processor 110. Such machine or computer readable media associated with the applications module 200 and other OS application modules can comprise a computer software product. It should be appreciated that a computer software product comprising the applications module 200 and other OS application modules can also be associated with one or more processes or methods for delivering the applications module 200 and other OS application modules to the computing machine via a network, any signal-bearing medium, or any other communication or delivery technology. The applications module 200 and other OS application modules can also comprise hardware circuits or information for configuring hardware circuits such as microcode or configuration information for an FPGA or other PLD. In one exemplary embodiment, applications module 200 and other OS application modules can include algorithms capable of performing the functional operations described by the flow charts and computer systems presented herein.

The input/output ("I/O") interface 150 can be configured to couple to one or more external devices, to receive data from the one or more external devices, and to send data to the one or more external devices. Such external devices along with the various internal devices can also be known as peripheral devices. The I/O interface 150 can include both electrical and physical connections for coupling the various peripheral devices to the computing machine or the processor 110. The I/O interface 150 can be configured to communicate data, addresses, and control signals between the peripheral devices, the computing machine, or the processor 110. The I/O interface 150 can be configured to implement any standard interface, such as small computer system interface ("SCSI"), serial-attached SCSI ("SAS"), fiber channel, peripheral component interconnect ("PCP"), PCI express (PCIe), serial bus, parallel bus, advanced technology attached ("ATA"), serial ATA ("SATA"), universal serial bus ("USB"), Thunderbolt, FireWire, various video buses, and the like. The I/O interface 150 can be configured to implement only one interface or bus technology. Alternatively, the I/O interface 150 can be configured to implement multiple interfaces or bus technologies. The I/O interface 150 can be configured as part of, all of, or to operate in conjunction with, the system bus 120. The I/O interface 150 can include one or more buffers for buffering transmissions between one or more external devices, internal devices, the computing machine, or the processor 120.

The I/O interface 120 can couple the computing machine to various input devices including mice, touch-screens, scanners, electronic digitizers, sensors, receivers, touchpads, trackballs, cameras, microphones, keyboards, any other pointing devices, or any combinations thereof. The I/O interface 120 can couple the computing machine to various output devices including video displays, speakers, printers, projectors, tactile feedback devices, automation control, robotic components, actuators, motors, fans, solenoids, valves, pumps, transmitters, signal emitters, lights, and so forth.

The computing machine 100 can operate in a networked environment using logical connections through the NIC 160 to one or more other systems or computing machines across a network. The network can include wide area networks (WAN), local area networks (LAN), intranets, the Internet, wireless access networks, wired networks, mobile networks, telephone networks, optical networks, or combinations thereof. The network can be packet switched, circuit switched, of any topology, and can use any communication protocol. Communication links within the network can involve various digital or an analog communication media such as fiber optic cables, free-space optics, waveguides, electrical conductors, wireless links, antennas, radio-frequency communications, and so forth.

The processor 110 can be connected to the other elements of the computing machine or the various peripherals discussed herein through the system bus 120. It should be appreciated that the system bus 120 can be within the processor 110, outside the processor 110, or both. According to some embodiments, any of the processors 110, the other elements of the computing machine, or the various peripherals discussed herein can be integrated into a single device such as a system on chip ("SOC"), system on package ("SOP"), or ASIC device.

Embodiments may comprise a computer program that embodies the functions described and illustrated herein, wherein the computer program is implemented in a computer system that comprises instructions stored in a machine-readable medium and a processor that executes the instructions. However, it should be apparent that there could be many different ways of implementing embodiments in computer programming, and the embodiments should not be construed as limited to any one set of computer program instructions unless otherwise disclosed for an exemplary embodiment. Further, a skilled programmer would be able to write such a computer program to implement an embodiment of the disclosed embodiments based on the appended flow charts, algorithms and associated description in the application text. Therefore, disclosure of a particular set of program code instructions is not considered necessary for an adequate understanding of how to make and use embodiments. Further, those skilled in the art will appreciate that one or more aspects of embodiments described herein may be performed by hardware, software, or a combination thereof, as may be embodied in one or more computing systems. Moreover, any reference to an act being performed by a computer should not be construed as being performed by a single computer as more than one computer may perform the act.

The example embodiments described herein can be used with computer hardware and software that perform the methods and processing functions described previously. The systems, methods, and procedures described herein can be embodied in a programmable computer, computer-executable software, or digital circuitry. The software can be stored on computer-readable media. For example, computer-readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays (FPGA), etc.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the description herein.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a system for controlling an amount of friction modifier channeled through at least one wellbore for use in hydraulic fracturing of at least one reservoir, the system comprising: a pump for injecting a friction modifier into a wellbore; a friction modifier controller configured to: monitor at least one of a fluid flow rate and pressure associated with a wellbore, compare the at least one of the fluid flow rate and the pressure with at least one of a desired flow rate and desired pressure, and adjust a friction modifier level based on results of the comparison; and an injector configured to control the pump to delivery an amount of friction modifier into the wellbore based on the friction modifier level;

Clause 2, the system of clause 1 further comprising at least one of a flow rate monitor configured to measure fluid flow rate and a pressure monitor configured to measure pressure of fluid pumped into the wellbore;

Clause 3, the system of clause 1 further comprising at least one other pump for injecting a friction modifier into at least one other wellbore;

Clause 4, the system of clause 3 further comprising at least one of a flow rate monitor configured to measure fluid flow rate and a pressure monitor configured to measure pressure of fluid pumped into each wellbore;

Clause 5, the system of clause 3, wherein the friction modifier controller is configured to: monitor at least one of a fluid flow rate and pressure associated with each wellbore, compare the at least one of the fluid flow rate and the pressure with at least one of a desired flow rate and a desired pressure for each wellbore, and adjust at least one friction modifier level based on results of the comparisons;

Clause 6, the system of clause 5, wherein the injector is further configured to control the pump to delivery an amount of friction modifier into at least one other wellbore based on the at least one friction modifier level;

Clause 7, the system of clause 3, wherein each pump has associated therewith a friction modifier controller and each friction modifier controller is configured to: monitor at least one of a fluid flow rate and pressure associated with each wellbore, compare the at least one of the fluid flow rate and the pressure with at least one of a preset desired flow rate and preset desired pressure, and adjust at least one friction modifier level based on results of the comparisons;

Clause 8, the system of clause 7, wherein the injector is further configured to control the pump to delivery an amount of friction modifier into at least one other wellbore based on the at least one friction modifier level.

Clause 9, a method for controlling an amount of friction modifier channeled through at least one wellbore for use in hydraulic fracturing of at least one reservoir, the method comprising: injecting, from a pump, a friction modifier into a wellbore; monitoring at least one of a fluid flow rate and pressure associated with the wellbore; comparing the at least one of the fluid flow rate and the pressure with at least one of a desired flow rate and desired pressure; adjusting a friction modifier level based on results of the comparison; and controlling the pump to deliver a friction modifier into the wellbore based on the friction modifier level;

Clause 10, the method of clause 9 further comprising measuring at least one of fluid flow rate and pressure of fluid pumped into the wellbore;

Clause 11, the method of clause 9 further comprising further comprising injecting, from at least one other pump, a friction modifier into at least one other wellbore;

Clause 12, the method of clause 11 further comprising measuring at least one of fluid flow rate and pressure of fluid pumped into each wellbore;

Clause 13, the method of clause 11 further comprising: monitoring at least one of a fluid flow rate and pressure associated with each wellbore, comparing the at least one of the fluid flow rate and the pressure with at least one of a desired flow rate and a desired pressure for each wellbore, and adjusting at least one friction modifier level based on results of the comparisons;

Clause 14, the method of clause 13 further controlling, the at least one other pump, to deliver an amount of friction modifier into at least one other wellbore based on the at least one friction modifier level;

Clause 15, the method of clause 11, wherein each pump has associated therewith a friction modifier controller, further comprising: monitoring at least one of a fluid flow rate and pressure associated with each wellbore, comparing the at least one of the fluid flow rate and the pressure with at least one of a preset desired flow rate and preset desired pressure, and adjusting at least one friction modifier level based on results of the comparisons;

Clause 16, the method of clause 15 further comprising controlling, at each pump, delivery of an amount of friction modifier into at least one other wellbore based on the at least one friction modifier level;

Clause 17, an apparatus for controlling an amount of friction modifier channeled through at least one wellbore for use in hydraulic fracturing of at least one reservoir, the apparatus comprising: a friction modifier controller configured to: monitor at least one of a fluid flow rate and pressure associated with at least one wellbore, compare the at least one of the fluid flow rate and the pressure with at least one of a preset desired flow rate and preset desired pressure; and control a level of a friction modifier delivered into at least one wellbore based on results of the comparison;

Clause 18, the apparatus of clause 17 further comprising: a pump for injecting a friction modifier into a wellbore at least one of a flow rate monitor configured to measure fluid flow rate and a pressure monitor configured to measure pressure of fluid pumped into at least one wellbore; and an injector configured to control the pump to delivery an amount of friction modifier into the wellbore based on the friction modifier level;

Clause 19, the apparatus of clause 17 wherein the friction modifier controller is communicably coupled with at least one of a flow rate monitor configured to measure fluid flow rate and a pressure monitor configured to measure pressure of fluid pumped into at least one wellbore; and Clause 20, the apparatus of clause 17 wherein the friction modifier controller is communicable coupled with at least one other injector configured to inject a friction modifier into at least one wellbore based on the level.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. A system for controlling an amount of friction modifier channeled through a plurality of wellbores for use in hydraulic fracturing of at least one reservoir, the system comprising:

a friction modifier controller configured to:

monitor at least one of a first fluid flow rate and a first pressure associated with a first wellbore of the plurality of wellbores;

monitor at least one of a second fluid flow rate and a second pressure associated with a second wellbore of the plurality of wellbores, perform a first comparison of the at least one of the first fluid flow rate and the first pressure with at least one of a first desired flow rate and a first desired pressure associated with the first wellbore;

perform a second comparison of the at least one of the second fluid flow rate and the second pressure with at least one of a second desired flow rate and a second desired pressure; and adjust at least one of a first friction modifier level associated with the first wellbore based on results of the first comparison, and a second friction modifier level associated with the second wellbore based on results of the second comparison; and a pumping system configured to:

inject a first amount of friction modifier into the first wellbore based on the first friction modifier level; and inject a second amount of friction modifier into the second wellbore based on the second modifier level.

2. The system of claim 1 further comprising at least one of a flow rate monitor configured to measure fluid flow rate and a pressure monitor configured to measure pressure of fluid pumped into the first wellbore or the second wellbore.

3. The system of claim 1 further comprising at least one other pump for injecting a friction modifier into at least one other wellbore of the plurality of wellbores.

4. The system of claim 3 further comprising at least one of a flow rate monitor configured to measure fluid flow rate and a pressure monitor configured to measure pressure of fluid pumped into each wellbore of the plurality of wellbores.

5. The system of claim 3, wherein the friction modifier controller is configured to:

monitor at least one of a fluid flow rate and pressure associated with each wellbore of the plurality of wellbores, compare the at least one of the fluid flow rate and the pressure with at least one of a desired flow rate and a desired pressure for each wellbore, and adjust at least one friction modifier level based on results of the comparisons.

6. The system of claim 5, wherein the pumping system is further configured to inject an amount of friction modifier into at least one other wellbore based on the at least one friction modifier level.

7. The system of claim 3, wherein each pump has associated therewith a corresponding friction modifier controller and each friction modifier controller is configured to:

monitor at least one of a fluid flow rate and pressure associated with at least one wellbore of the plurality of wellbores, compare the at least one of the fluid flow rate and the pressure with at least one of a preset desired flow rate and preset desired pressure, and adjust at least one friction modifier level based on results of the comparisons.

8. The system of claim 7, wherein the pumping system is further configured to inject an amount of friction modifier into at least one other wellbore based on the at least one friction modifier level.

9. A method for controlling an amount of friction modifier channeled through a plurality of wellbores for use in hydraulic fracturing of at least one reservoir, the method comprising:

injecting, from a pump of a pumping system, a friction modifier into a first wellbore and a second wellbore of the plurality of wellbores;

monitoring at least one of a first fluid flow rate and a first pressure associated with a first wellbore of the plurality of wellbores;

monitoring at least one of a second fluid flow rate and a second pressure associated with a second wellbore of the plurality of wellbores;

performing a first comparison the at least one of the first fluid flow rate and the first pressure with at least one of a first desired flow rate and a first desired pressure associated with the first wellbore;

performing a second comparison of the at least one of the second fluid flow rate and the second pressure with at least one of a second desired flow rate and a second desired pressure associated with the second wellbore;

adjusting at least one of a first friction modifier level associated with the first wellbore based on results of the first comparison, and a second friction modifier level associated with the second wellbore based on results of the second comparison; and controlling the pumping system to:

inject a first amount of friction modifier into the first wellbore based on the first friction modifier level; and inject a second amount of friction modifier into the second wellbore based on the second modifier level.

10. The method of claim 9 further comprising measuring at least one of fluid flow rate and pressure of fluid pumped into at least one wellbore of the plurality of wellbores.

11. The method of claim 9 further comprising injecting, from at least one other pump of the pumping system, a friction modifier into at least one other wellbore of the plurality of wellbores.

12. The method of claim 11 further comprising measuring at least one of fluid flow rate and pressure of fluid pumped into each wellbore of the plurality of wellbores.

13. The method of claim 11 further comprising:

monitoring at least one of a fluid flow rate and pressure associated with each wellbore of the plurality of wellbores, comparing the at least one of the fluid flow rate and the pressure with at least one of a desired flow rate and a desired pressure for each wellbore, and adjusting at least one friction modifier level based on results of the comparisons.

14. The method of claim 13 further comprising controlling, the at least one other pump, to deliver an amount of friction modifier into at least one other wellbore based on the at least one friction modifier level.

15. The method of claim 11, wherein each pump has associated therewith a friction modifier controller, further comprising:

monitoring at least one of a fluid flow rate and pressure associated with at least one wellbore, comparing the at least one of the fluid flow rate and the pressure with at least one of a preset desired flow rate and preset desired pressure, and adjusting at least one friction modifier level based on results of the comparisons.

16. The method of claim 15 further comprising controlling, at each pump, delivery of an amount of friction modifier into at least one other wellbore based on the at least one friction modifier level.

17. An apparatus for controlling an amount of friction modifier channeled through a plurality of wellbores for use in hydraulic fracturing of at least one reservoir, the apparatus comprising:

a friction modifier controller configured to:

monitor at least one of a first fluid flow rate and a first pressure associated with a first wellbore of the plurality of wellbores;

monitor at least one of a second fluid flow rate and a second pressure associated with a second wellbore of the plurality of wellbores, perform a first comparison of the at least one of the first fluid flow rate and the first pressure with at least one of a first desired flow rate and a first desired pressure associated with the first wellbore;

perform a second comparison of the at least one of the second fluid flow rate and the second pressure with at least one of a second desired flow rate and a second desired pressure associated with the second wellbore;

adjust at least one of a first friction modifier level associated with the first wellbore based on results of the first comparison, and a second friction modifier level associated with the second wellbore based on results of the second comparison; and request a pumping system to:

inject a first amount of friction modifier into the first wellbore based on the first friction modifier level; and inject a second amount of friction modifier into the second wellbore based on the second modifier level.

18. The apparatus of claim 17 further comprising:

a pump for injecting a friction modifier into a wellbore;

at least one of a flow rate monitor configured to measure fluid flow rate and a pressure monitor configured to measure pressure of fluid pumped into at least one wellbore; and an injector configured to control the pump to deliver an amount of friction modifier into the wellbore based on the friction modifier level.

19. The apparatus of claim 17 wherein the friction modifier controller is communicably coupled with at least one of a flow rate monitor configured to measure fluid flow rate and a pressure monitor configured to measure pressure of fluid pumped into at least one wellbore.

20. The apparatus of claim 17 wherein the friction modifier controller is communicably coupled with at least one other injector configured to inject a friction modifier into at least one wellbore based on the level.

* * * * *